United States Patent [19]

Loos

[11] 4,034,547

[45] July 12, 1977

[54] COMPOSITE CABLE AND METHOD OF MAKING THE SAME

[76] Inventor: August W. Loos, c/o Loos & Company, Inc., Quasset Lake Road, Pomfret, Conn. 06258

[21] Appl. No.: 700,081

[22] Filed: July 6, 1976

Related U.S. Application Data

[63] Continuation-in-part of Ser. No. 603,672, Aug. 11, 1975, abandoned.

[51] Int. Cl.[2] ..... D07B 1/04

[52] U.S. Cl. ..... 57/146; 57/161

[58] Field of Search ..... 57/9, 34 R, 139, 144, 57/145, 146, 147, 148, 156, 160, 161

[56] References Cited

U.S. PATENT DOCUMENTS

| | | | |
|---|---|---|---|
| 1,809,032 | 6/1931 | Gregson | 57/9 |
| 1,972,290 | 9/1934 | Conner | 57/9 |
| 3,641,755 | 2/1972 | Heinen | 57/9 |
| 3,686,855 | 8/1972 | Falcy et al. | 57/146 X |
| 3,837,152 | 9/1974 | Dakhov et al. | 57/9 |
| 3,842,584 | 10/1974 | Schmittman | 57/146 |
| 3,911,785 | 10/1975 | Hood | 57/144 X |

FOREIGN PATENT DOCUMENTS

| | | | |
|---|---|---|---|
| 173,216 | 11/1952 | Austria | 57/146 |
| 179,154 | 7/1954 | Austria | 57/146 |

*Primary Examiner*—Donald Watkins
*Attorney, Agent, or Firm*—Prutzman, Hayes, Kalb & Chilton

[57] ABSTRACT

A cable is disclosed having a wire rope jacket and a synthetic compressible core of yarn filaments with a specific tensile strength greater than the members of the jacket and which serve as a reinforcing component for the jacket to provide a cable construction suited for service conditions requiring a strength greater than a conventional steel cable. A method of making cable is set forth which lends itself to economical and dependable manufacture wherein a yarn core is drawn through a closing die in a substantially zero twist parallel arrangement and drawing a plurality of wires through the die in timed relation to passage of the core to be helically laid about the core to form a twisted wire rope jacket.

16 Claims, 10 Drawing Figures

COMPOSITE CABLE AND METHOD OF MAKING THE SAME

This application is a continuation-in-part of applicant's copending application Ser. No. 603,672, filed Aug. 11, 1975, now abandoned.

FIELD OF THE INVENTION

This invention generally relates to wire rope and cable and particularly concerns such a cable of a composite construction having a synthetic yarn multi-filament core and a surrounding wire rope jacket.

BACKGROUND OF THE INVENTION

Conventional wire rope and cable normally features a metallic core or textile core. Cable with metallic core has a disadvantage of being expensive and exceedingly heavy in long lengths. Cable with textile core of natural or synthetic fiber or yarn are normally combined and twisted together to impart various characteristics to the cable depending on the type of synthetic used. Textile core normally does not contribute to the strength of a cable but serves usually simply as a filler which keeps the cable round with the wire layers correctly spaced and supported, cushions shock loading and enhances flexibility as well as to minimize excessive friction and consequent wear of adjacent wires or strands. Textile core has a disadvantage of being normally dimensionally unstable in length, and nylon in particular is water absorbent. Even when lubricated, the ultimate elongation and tensile strength of nylon has been found to vary when used in water in response to changes in the moisture content of the nylon core.

Various attempts have been repeatedly made to combine different natural and synthetic fibers of yarns together with different types of jacket materials, e.g., plastic of different types which serve to prevent synthetic cores from having their individual filaments or strands separate and to further enhance the ability of the cable to withstand wear. Plastic impregnation of synthetic core materials is frequently employed to provide sufficient core body and to bond the core fibers. Sometimes a synthetic layer is interposed between a synthetic core fiber and the outer plastic jacket to serve as a moisture barrier. These particular specialized constructions have a disadvantage of normally undesirably restricting movement of the core fibers due to the bonded plastic coating and/or plastic impregnation of the core fibers. In addition, careful selection of a plastic jacket or sheathing must be exercised for a particular application to which the cable is to be used since certain plastics may not be compatible with the application. For example, polypropylene has a high coefficient of friction with wood and, when used as sheathing, exhibits a tendency to stick to wood so that when stressed, a rope or cable of polypropylene moves in rapid jerks causing localized frictional heating which results in rapid deterioration because of the well known low melting point of polypropylene. Accordingly, polyproplene type ropes and cables have to be provided with lubrication or other types of plastic strands to minimize the effective friction. Moreover, multi-filament fiber centers formed of polypropylene or hemp, etc., tend to exhibit substantially greater stretch characteristics and lower ultimate break strengths than wire ropes with metal cores.

It is well known to those in the art that certain types of plastic, while being adapted to a particular application, are not compatible with other types of plastic. An example is that of nylon, which is water absorbent and is not compatible with polypropylene yarns which do not absorb water; this incompatibility also exists between polyester and polypropylene yarns.

In short, problems confronting a maker of cable or rope vary significantly and are compounded with respect to the variety of available materials depending on an end use to which the rope or cable is to be applied.

OBJECTS OF THE INVENTION

A principal object of this invention is to provide a new and improved composite cable having a breaking strength significantly greater than known standard wire rope or cable of comparable diameter and which exhibits extraordinary savings in weight relative to an all metallic rope or cable of comparable length.

Another object of this invention is to provide such a cable having a wire rope jacket and a synthetic core wherein the core serves as a reinforcing strength member for the jacket.

Yet another object of this invention is to provide a cable of the described type which is flexible, is dimensionally stable in length even when used in water without lubrication and which is highly resistant to heat, corrosion, weather, abrasion and stretch, while also exhibiting the desired characteristics of toughness and excellent impact strength, good vibration damping and resistance to crushing, in addition to having a low coefficient of friction with both wood and steel.

A further object of this invention is to provide such a cable particularly suited for so-called "guying" applications while also satisfactorily serving as a cable for general purpose applications featuring a long service life under demanding conditions while being economical to manufacture at high production rates.

Another object of this invention is to provide a new and improved method of manufacture of a cable and which is particularly suited for low cost high production operation with standard equipment to provide a cable of significantly improved performance characteristics.

Other objects will be in part obvious and in part pointed out more in detail hereinafter.

A better understanding of this invention will be obtained from the following detailed description and the accompanying drawings of an illustrative embodiment of this invention.

DESCRIPTION OF A PREFERRED EMBODIMENT

Figure 1:
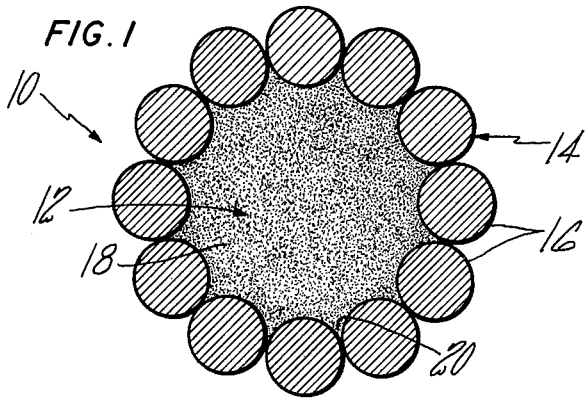
FIG. 1 is a cross-sectional view of a composite cable incorporating this invention.
Figure 2:
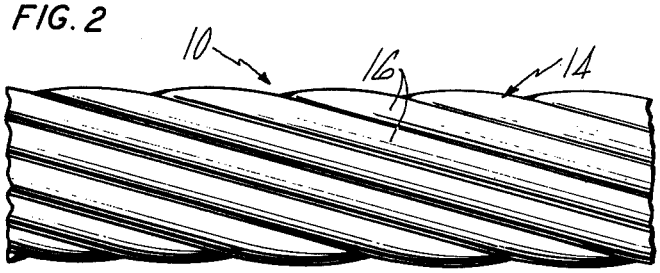
FIG. 2 is a longitudinal side view of the cable of FIG. 1 on a reduced scale.
Figure 3:
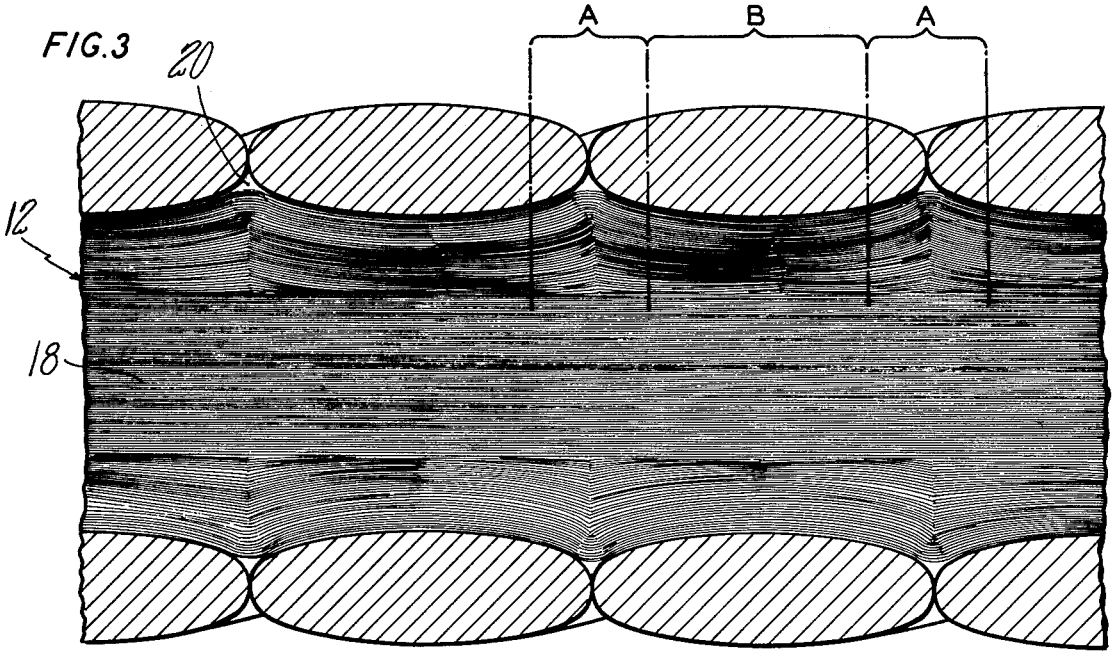
FIG. 3 is an enlarged longitudinal sectional view of the cable of FIG. 1.

Referring to the drawings in detail, a cable 10 is illustrated wherein the basic elements are a core 12 and a wire rope jacket 14 having a plurality of twelve substantially identical metallic wires 16 shown laid in a helical twist about the core 12. The illustrated embodiment of FIGS. 1–3 shows single wires 16 arranged to circumscribe the core 12 and extending longitudinally of the core 12.

It will be understood that the wires 16 could be each replaced by a strand wherein a plurality of wires are laid about a center core to form each strand with a plurality of such strands then being helically wrapped around the main core in one or more layers to form the cable. Such construction is shown in FIGS. 7–10 illustrative of other embodiments incorporating this invention.

The wires 16 comprising the jacket 14 are preferably formed of a standard stainless steel such as AISI (American Iron and Steel Institute) 302 or 304 which, as is well known, provide maximum strength and longevity and exhibit excellent mechanical qualities with respect to elasticity, resistance to tension, heat, corrosion, abrasion, weather and water and has high fatigue resistance.

To provide a significantly improved cable having a tensile strength which even exceeds that, e.g., of an all stainless steel cable of approximately equal diameter while at the same time considerably reducing the weight of the cable 10 relative to a comparable size stainless steel cable in a unitary construction which is dimensionally stable lengthwise and yet features a combined sharing of the entire working load imposed on the cable, the core 12 is preferably formed of a bundle of continuous synthetic fibers 18 having a specific tensile strength (tensile strength to density ratio) selected to be higher than that of the members 16 of the jacket 14. To effect maximum concentration of fibers 18 in a given cross-section for an improved core body while also ensuring that the interstices 20 (FIGS. 1 and 3) are filled between members 16 of wire rope jacket 14, this invention features a core bundle 12 which is soft, continuous, flexible and compressible.

More specifically, a cable featuring the foregoing desired characteristics of this invention are achieved by the provision of a hoop tension imposed by the wires 16 of the jacket 14 which are continuous members 16 wrapped about the core 12 to apply a radially inwardly directed compressive force to the outer surface of the core 12 as best seen in FIG. 3. The outer surface contour is compressed in an alternating contoured pattern which uniformly varies axially of the core bundle from zones of minimum stress between the wires, such as at "A" in FIG. 3 to zones of maximum compressive stress such as at "B" intermediate the minimum stress zones "A". It is believed that such construction effectively serves to compress the core 12 to reduce trapped air within the bundle 12, ensures diametrical conformity of the individual wires 16 of the jacket 14 and increases the ability of the core and jacket components 12 and 14 to serve as a unitary cable structure under most operating conditions due to the resulting effective friction between the core bundle 12 and jacket created by the above described selective zones of compression.

A synthetic fiber found to be satisfactory for use in this invention, e.g., is a high modulus organic aramid fiber such as presently marketed in the form of aromatic polyamide yarn filaments by E. I. duPont deNemours & Company, Inc. under the trademark KEVLAR 29. Such aramid fibers exhibit desired corrosion and crush resistance in addition to excellent toughness, high impact strength, high stress-rupture life and an extraordinarily high specific tensile strength. The filament diameter of KEVLAR 29 is aout 0.00047 inch and is supplied in 1500 denier yarns (although other deniers may be effectively utilized) of 1,000 filaments weighing about 0.111 pound per 1,000 feet. The tensile strength is about 400,000 psi, which is more than six times that of nylon monofilament, and with a density of 0.053 pounds per cubic inch density, the specific tensile strength of $8 \times 10^6$ inch of KEVLAR 29 is greater than any known metal conventionally used in wire rope and cable.

Testing of the composite cable 10 of this invention has been conducted and compared to standard stainless steel cable of comparable size. Comparisons have been made between corresponding sizes of cables and an average ultimate breaking strength was taken from not less than three separate runs of each cable tested to determine the ultimate break strength of the size and type cable being tested. I.e., the ultimate load to which a tensile failure occurred was determined for the cables tested, the testing being conducted on conventional Tinius Olson tensile testing equipment in a well-known manner.

The following table sets forth the results obtained in testing four different diameter sizes of cable of AISI 302 stainless steel having a 10 pitch ratio in a 1 × 19 construction with a center or core wire, a first layer of six wires and a second layer of twelve wires cross laid relative to the first layer and forming the outside surface of the cable.

Composite 302 STAINLESS STEEL CABLE I.A.W. MIL-W-5693C
(diameter in inches and area in square inches)

| | | | | |
|---|---|---|---|---|
| Nominal diameter | 1/8 | 5/32 | 3/16 | 1/4 |
| Core wire diameter | 0.026 | 0.035 | 0.040 | 0.054 |
| Surrounding | diameter | 0.026 | 0.032 | 0.038 |
| Core wire area | 0.000531 | 0.0009621 | 0.0012566 | 0.0022902 |
| Surrounding wire area | 0.0095562 | 0.0144756 | 0.0204128 | 0.035343 |
| Total wire area | 0.0100871 | 0.0154377 | 0.0216946 | 0.0376332 |
| Total weight in pounds per 1000 feet | 37.5 | 57.36 | 80.51 | 140 |
| Ultimate break in pounds | 2367 | 3500 | 4800 | 8980 |

The above results are to be compared with the following table of results obtained in testing comparable sizes of composite cable of this invention. The described aramid fiber core 12 of the composite cable 10 was sheathed in a wire rope jacket 14 comprising twelve AISI 302 stainless steel wires of the type used in the testing of the all steel cable and having a pitch ratio equivalent thereto of about 10, i.e., wherein the lay or length of each helical wrap of the outside circumscribing wires was about ten times the outside cable diameter.

twisted steel jacket has the ability to draw or elongate to equalize load, and this feature is believed to effectively enhance the load sharing capability of the cable 10 wherein its disclosed construction will permit such relative movement between the core and jacket components 12 and 14, e.g., under heavy tensile loading.

Moreover, the relative movement permitted of the core element in relation to the jacket provides flexing characteristics normally associated with a twisted core COMPOSITE CABLE
(diameter in inches and area in square inches)

| | | | | |
|---|---|---|---|---|
| Nominal diameter | 1/8 | 5/32 | 3/16 | 1/4 |
| Core diameter | 0.078 | 0.099 | 0.120 | 0.167 |
| Number of 1500 denier yarns in core | 223 | 37 | 54 | 104 |
| Wire diameter | 0.026 | 0.032 | 0.038 | 0.050 |
| Core area | 0.0047783 | 0.0076977 | 0.0113 | 0.0219 |
| Wire area | 0.006371 | 0.00965 | 0.013609 | 0.023556 |
| Total core and wire area | 0.0111493 | 0.0173481 | 0.024909 | 0.045462 |
| Total weight in pounds per 1000 feet | 26.35 | 40.16 | 56.82 | 99.66 |
| Ultimate break in pounds | 2870 | 4300 | 5890 | 11,067 |
| % increase in ultimate breaking strength over stainless steel cable | 21.25% | 22.86% | 22.71% | 23.24% |

Based on the above results, the described synthetic core 12 when united with the wire rope jacket 14 of this invention has been found to provide a composite cable 10 of a weight approximately 30% lighter than the weight of the corresponding size stainless steel cable and an increase in ultimate breaking strength of the cable of at least 20% relative to a standard stainless steel cable of comparable size.

The described core component 12 accordingly serves as a reinforcing element for the jacket 14 to provide a lightweight cable 10 having a significantly increased tensile load bearing capacity.

In addition, seemingly incompatible objectives of (1) maximizing the elastic modulus of the aromatic polyamide filaments 18 to reduce core strength under load and also (2) effectively equalizing the sharing of working loads among the cable components are obtained by forming the core component with its filaments arranged within its twisted stainless steel jacket in a substantially parallel, zero twist relationship which additionally minimizes core filament friction, abrasion and wear in a high strength cable construction adapted for a variety of different end uses.

The disclosed substantially no twist parallel filament arrangement of the core 12 in combination with the selection of aromatic polyamide yarn filaments provides a composite cable with the desired high tensile, low stretch characteristics normally associated only with steel cables. Due to the lack of any significant elongation of the uniaxially aligned aromatic polyamide yarn filaments, which has a high modulus or resistance to stretch approaching that of steel, the normal load leveling which takes place with conventional low modulus twisted fiber cores does not occur, and it is believed that the disclosed parallel filament core maximizes the elastic modulus of the yarns to reduce core stretch whereby the low stretch characteristic of the disclosed core bundle is accordingly optimized.

In addition, the undesired imposition of stresses on a relatively few innermost core yarn filaments under load, which frequently occurs in conventional cables to result in ultimate elongation and failure, is believed to be effectively minimized. I.e., it is known that the construction and which is significantly improved over conventional plastic sheathed cables incorporating a synthetic parallel multifilament core bonded by plastic impregnation or a plastic coating, e.g., which undesirably restricts movement of core fibers and tends toward localized buckling and kinking.

Figure 4:
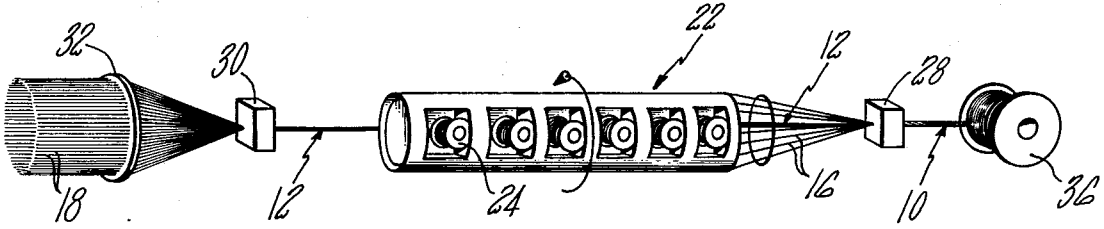
FIG. 4 is a schematic view of an apparatus used in making the cable of this invention.
Figure 5:
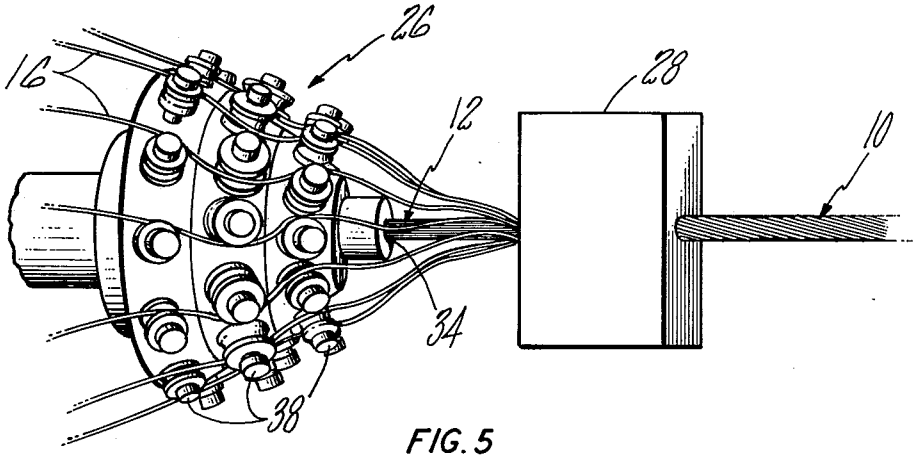
FIG. 5 is an isometric view, partly broken away, showing a component of the cable making apparatus of FIG. 4.

Referring now to a preferred method of manufacturing the composite cable construction in accordance with this invention, a conventional variable speed, power operated tubular strander 22 is schematically illustrated in FIG. 4. It will be understood that reels 24 corresponding to the number of wires of the cable are carried within the revolving strander for rotation about the longitudinal or spin axis of the machine 22 to pay off the wires 16 forwardly to a preforming head 26 (FIG. 5) adjacent a downstream closing die 28 in a well-known manner. The machine has a second closing die 30 shown upstream of the tubular strander 22. Yarn filaments 18 of the core 12 are paid off a panel board, not shown, in an untwisted condition into a fixed filament tensioning unit 32. From tensioning unit 32, the yarn core 12 is fed into the upstream closing die 30 in zero twist parallel relation and into the high speed tubular strander 22, and into an axial guideway 34 in performing head 26 to be fed through the downstream closing die 28 with the core filaments 18 drawn under tension together with the wires 16 by a power operated take-up reel 36. It will be understood that the wires 16 upon being paid off their reels 24 are trained along the periphery of the revolving strander 22 which effects a spinning motion to lay the wires 16 about the core 12 in the pattern required. If desired, the yarn core 12 may also be trained along the periphery of the strander 22 before emerging fron guideway 34 in axial alignment adjacent the closing die 28.

Accordingly, the core component as it is being fed into and through the downstream closing die 28 is in effect being held against turning motion relative to the spin axis by the upstream and downstream closing dies 30, 28 such that any twist which might be imparted by the tubular strander 22 to the core component 12 is rendered ineffective just before the core 12 is drawn through the downstream closing die 28, thereby to ensure that the core 12 is fed through die 28 in a substantially no twist condition. Hence the ends of core component 12 are effectively held by the upstream and downstream closing dies 30, 28 not unlike the ends of a jump rope, whereby the core 12 is drawn into the downstream closing die 28 in a substantially zero twist parallel arrangement at the time the circumscribing stainless steel wires 16 pass off preforming rollers 38 in a conventional manner on the closing component of the machine just before being laid around the core 12. It will be understood that each circumscribing wire 16 is passed over and under a series of three rollers 38 to preset the helical twist that the individual wires 16 are to assume in the finished cable. Preforming the wires 16 eliminates any internal stress which would normally occur in the helically twisted circumscribing wires which are laid about the core component for a longer cable life under demanding operating conditions.

Turning now to the additional embodiments of this invention illustrated in FIGS. 6–10, these drawings show how the cable of this invention may vary in its application as well as in the specific construction of its individual units or strands. A strand consists simply of a specific number of wires preferably helically laid in a symmetrical arrangement in one or more layers about an axis, or another wire or fiber center. The embodiment of FIGS. 1–3, e.g., can be utilized as a single strand in a multistrand cable. The number of individual wirelike members, e.g., depicted in each construction may also vary in number, size, shape and material. That is, the specific number of surface or cover wires laid, preferably in a helical arrangement, in a concentric layer about a center core may vary as best shown in FIGS. 6–10.

The cables of FIGS. 6–10 each comprise at least one strand having a core and a jacket. As in the embodiment of FIGS. 1–3, the jacket of each cable shown in FIGS. 6–10 includes a plurality of continuous wirelike metal members laid about its core. In accordance with this invention, the core includes a bundle of low stretch lightweight continuous synthetic fibers having a high tensile strength to density ratio with the core fibers being in the form of a yarn of aromatic polyamide filaments, e.g., or a core fiber which has a specific tensile strength greater than that of the metal members of the jacket and which core fiber serves as a reinforcing component for the metal members of the jacket.

In each of the illustrated embodiments of FIGS. 6–10, the core and jacket components are movable relative to one another, and the jacket itself is preferably formed of a pluality of members which are helically laid in a layer about the core. As in the embodiments of FIGS. 1–3, each individual composite strand of each cable in FIGS. 6–10 has an ultimate breaking strength which exceeds by 20% the ultimate breaking strength of a comparable conventional metal strand of corresponding size formed, e.g., of AISI 302 stainless steel, and is about 30% ligher than the weight of such comparable stainless steel strand. It is to be understood that the wirelike members of the jacket of each cable strand shown in FIGS. 6–10 collectively effect a hoop tension about the core and compressively engage the outer surface of the core bundle as best illustrated in FIG. 3 of the first embodiment of this invention. That is, the outer surface of the core bundle is compressively stressed radially inward in an alternating pattern which uniformly varies from zones of minimum stress between wires to zones of maximum compressive stress intermediate the zones of minimum stress.

Figure 6:
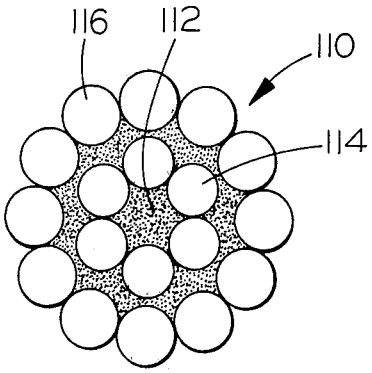
FIG. 6 is a cross sectional view of another embodiment of a composite cable incorporating this invention.

FIG. 6 illustrates an embodiment of a cable 110 incorporating this invention wherein its core 112 is formed with the above described soft, no-twist parallel filament yarn surrounded by concentric layers of wires. In the specifically illustrated embodiment, six inner wires such as at 114 are helically laid about the core with an additional outer layer of twelve substantially identical helically laid wires 116. The above-described filament yarn of a type identical to the core material is shown interposed between the layers of wires 114, 116 and fills the interstices.

Figure 7:
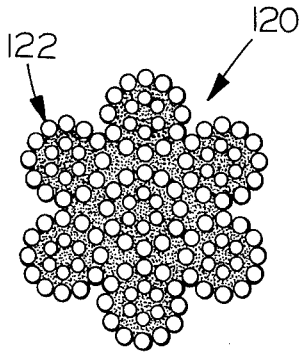
FIG. 7 is a cross sectional view of yet another embodiment of a composite cable incorporating this invention.

FIG. 7 illustrates a composite cable 120 which comprises a plurality of units or strands such as at 122 each substantially identical to the cable 110 illustrated in the embodiment of FIG. 6. That is, each strand 122 is identical to the cable embodiment 110 shown in FIG. 6. Six such strands 122 are shown in a helically wrapped concentric layer about a center strand of identical construction wherein the yarn of aromatic polyamide filaments is also provided between the center strand and its surrounding outer surface strands.

Figure 8:
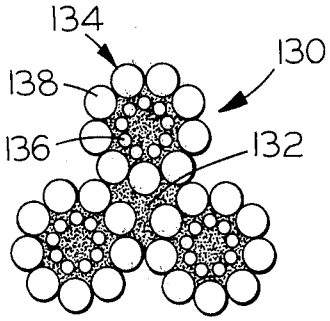
FIG. 8 is a cross sectional view of a further embodiment of a composite cable incorporating this invention.

The cable 130 of FIG. 8 comprises a yarn bundle 132 of aromatic polyamide filaments as described above in connection with the embodiment of FIGS. 1–3, serving as a core with three substantially identical strands such as at 134 surrounding core 132. Strands 134 will be understood to be laid in a helical twist relative to the core 132 with each of strands 134 comprising nine substantially identical, small diameter inner metal wires such as at 136 surrounding the strand core and nine larger diameter outer metal wires such as at 138 providing the circumscribing jacket element. Soft, compressible, low stretch, lightweight, continuous aromatic polyamide fibers identical to that of the core of each individual strand 134 are shown provided between the inner and outer layers of wires 136 and 138.

Figure 9:
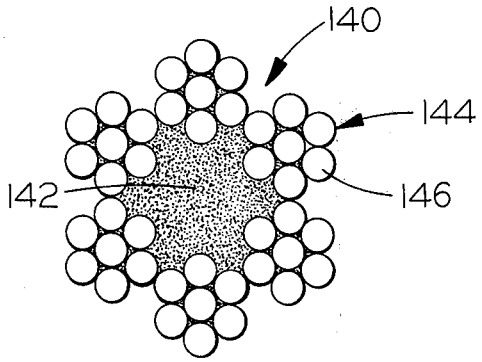
FIG. 9 is a cross sectional view of a yet another embodiment of a composite cable incorporating this invention.

Yet another composite cable 140 is illustrated in FIG. 9 wherein a core 142 is formed of a bundle of low stretch, lightweight, continuous fibers having a high tensile strength to density ratio in the form of yarn filaments of aromatic polyamide material. Six substantially identical metal strands such as at 144 surround core 142 and which will be understood to be helically load about the core bundle of yarn filaments. Each strand 144 has six substantially identical metallic wires such as at 146 which in turn are laid in a single layer in a helical twist about a center core wire identical to its surrounding wires. It is to be understood that additional layers could be laid about the outer metal jacket as depicted, e.g., in FIG. 6.

Figure 10:
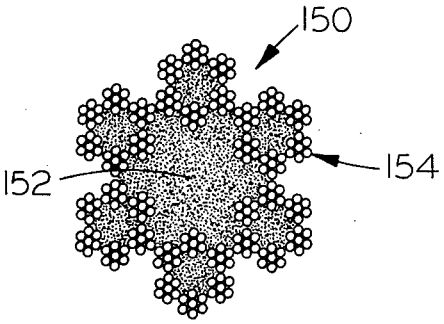
FIG. 10 is a cross sectional view of another embodiment of a composite cable incorporating this invention.

FIG. 10 depicts yet another embodiment of this invention wherein a cable 150 has a core 152 comprised of a bundle of parallel zero twist KEVLAR fibers surrounded by a metal jacket comprising six strands such as at 154 helically laid about core 152. Each strand 154 is identical to the above described embodiment shown in FIG. 9.

Corresponding results may be obtained in providing a cable according to this invention exhibiting the above described extraordinary tensile strength characteristics wherein the wirelike members of the composite cable are composed of any suitable metal. The following specific materials or combinations of materials are contemplated such as galvanized iron, mild plow steel, plow steel, improved plow steel, special improved plow steel, high carbon steel and other materials such as "Monel", aluminum, copper, phosphor bronze and similar materials and/or alloys.

In view of the disclosed method and resulting cable construction of this invention, it will be appreciated that a method of manufacture has been disclosed which is not only economical and relatively simple to implement at an economical cost, but the resulting product is a cable which with the soft, no twist parallel filament yarn core is uniquely compatible with its steel jacket to provide a tensile strength, low stretch and lightweight body never before achieved by any known combination of metallic wire jacket with an organic fiber core. While particularly suited for use as a guy wire and other "guying" applications wherein the extraordinary tensile strength characteristics achieved by the cable of this invention are most evident, the cable is also useful for a variety of different end uses in various industrial, marine and recreational applications including, but not limited, to mooring, tethering, hoisting and towing. It will be appreciated that with a cable of this invention, one may now use a smaller diameter size to perform the same job with a breaking strength previously obtainable only with a larger conventional cable of much greater weight.

As will be apparent to persons skilled in the art, various modifications, adaptations and variations of the foregoing specific disclosure can be made without departing from the teachings of this invention.

I claim:

1. A cable comprising a synthetic core and a metal jacket, the jacket being formed of a plurality of continuous wirelike members helically laid in a layer about the core, the core being formed of a bundle of low stretch lightweight continuous fibers having a high tensile strength to density ratio, the core fibers having a specific tensile strength greater than that of the members of the metal jacket and serving as a reinforcing component for the metal jacket, the core fibers constituting a soft compressible bundle to effect maximum concentration of fibers for a given cross-section and filling interstices between the wirelike members of the metal jacket, the jacket including a plurality of individual wires helically laid in a layer about the core with the wires collectively effecting a hoop tension about the core and applying a compressive force to its outer surface radially inward, the outer surface of the bundle being compressively stressed radially inward in an alternating pattern which uniformly varies axially of the bundle form zones of minimum stress between wires to zone of maximum compressive stress intermediate the zones of minimum stress.

2. A cable comprising a synthetic core and a metal jacket, the jacket being formed of a plurality of continuous wirelike members helically laid in a layer about the core, the core being formed of a bundle of low stretch lightweight continuous fibers having high tensile strength to density ratio, the core fibers being in the form of yarn filaments of aromatic polyamide filaments having individual deniers of 1500, the core fibers having a specific tensile strength greater than that of the members of the metal jacket and serving as a reinforcing component for the metal jacket.

3. A cable comprising a synthetic core and a metal jacket, the jacket being formed of a plurality of continuous wirelike members helically laid in a layer about the core, the core being formed of a bundle of low stretch lightweight continuous fibers having a high tensile strength to density ratio, the core fibers having a specific tensile strength greater than that of the members of the metal jacket and serving as a reinforcing component for the metal jacket, the core and jacket being movable relative to one another.

4. A cable comprising a synthetic core and a metal jacket, the jacket being formed of a plurality of continuous wirelike members helically laid in a layer about the core, the core being formed of a bundle of low stretch lightweight continuous fibers having a high tensile strength to density ratio, the core fibers having a specific tensile strength greater than that of the members of the metal jacket and serving as a reinforcing component for the metal jacket, the cabl having a breaking strength exceeding by 20% the breaking strength of a comparable conventional metal cable formed of AISI 302 stainless steel.

5. The cable of claim 4 wherein the cable is about 30% lighter in weight than that of said comparable stainless steel cable.

6. A composite cable comprising a core and a jacket, the core being formed of a compressible bundle of aromatic polyamide filaments laid in substantially parallel zero twist relation to one another, the jacket being a plurality of wires helically laid in a layer about the core with the wires collectively effecting a hoop tension about the core and compressively engaging the outer surface of the core bundle, the outer surface of the core bundle being compressively stressed radially inward in an alternating pattern which uniformly varies axially of the core from zones of minimum stress between wires to zones of maximum compressive stress intermediate the zones of minimum stress, the core serving as a unitary reinforcing component for the jacket with the core filaments having a specific tensile strength greater than that of the wires of the jacket.

7. A method of making a cable comprising the steps of supplying a continuous multifilament yarn to a closing die to serve as a cable core, spinning a plurality of reels of wire about a spin axis extending through the closing die, drawing a wire from each of the reels through the closing die to be helically laid about the core, and pulling the yarn core through the closing die in a substantially zero twist parallel arrangement in timed relation to passage of the wires through the die to form a composite cable having a twisted wire rope jacket surrounding a parallel laid multifilament yarn core.

8. The method of claim 7 wherein the spinning, drawing and pulling steps are simultaneously perfomred with the yarn core being pulled toward the closing die with a revolving motion about the spin axis of the wires.

9. The method of claim 7 wherein the pulling step is effected by pulling the yarn core filaments under tension and in parallel no twist alignment through a second closing die upstream of the wire reels and the first die.

10. The method of claim 7 including the additional step of preforming each of the wires to set a predetermined helical twist therein to minimize internal stress, prior to each wire passing through the closing die.

11. A cable comprising at least one strand having a core and a jacket, the jacket including a plurality of continuous wirelike metal members laid about the core, the core including a bundle of low stretch lightweight continuous synthetic fibers having a high tensile strength to density ratio, the core fibers being in the form of yarn filaments of aromatic polyamide filaments having individual deniers of 1500, the core fibers having a specific tensile strength greater than that of the metal members of the jacket and serving as a reinforcing component therefor.

12. A cable comprising at least one strand having a core and a jacket, the jacket including a plurality of continuous wirelike metal members laid about the core, the core including a bundle of low stretch lightweight continuous synthetic fibers having a high tensile strength to density ratio, the core fibers having a specific tensile strength greater than that of the metal members of the jacket and serving as a reinforcing component therefor, the core and jacket being movable relative to one another.

13. A cable comprising at least one strand having a synthetic core and a metal jacket, the jacket being formed of a plurality of continuous wirelike members helically laid in a layer about the core, the core being formed of a bundle of low stretch lightweight continuous fibers having ahigh tensile strength to density ratio, the core fibers having a specific tensile strength greater than that of the members of the metal jacket and serving as a reinforcing component for the metal jacket, the strand having a breaking strength exceeding by 20% the breaking strength of a comparable conventional metal strand formed of AISI 302 stainless steel.

14. The cable of claim 13 wherein the strand is about 305 lighter in weight than that of said comparable stainless steel strand.

15. A composite cable comprising at least one strand having a core and a jacket, the core being formed of a compressible bundle of aromatic polyamide filaments laid in substantially parallel zero twist relation to one another, the jacket being a plurality of wires helically laid in a layer about the core with the wires collectively effecting a hoop tension about the core and compressively engaging the outer surface of the core bundle, the outer surface of the core bundle being compressively stressed radially inward in an alternating pattern which uniformly varies axially of the core from zones of minimum stress between wires to zones of maximum compressive stress intermediate the zones of minimum stress, the core serving as a unitary reinforcing component for the jacket with the core filaments having a specific tensile strength greater than that of the wires of the jacket.

16. The cable of claim 15 wherein the cable is a multistrand cable comprising at least three of said one strand units.

* * * * *